United States Patent [19]

Erthein

[11] 4,355,743

[45] Oct. 26, 1982

[54] HEAVY AND LIGHT DUTY GARMENT CLAMPING HANGER

[75] Inventor: Marc Erthein, East Haddam, Conn.

[73] Assignee: National Hanger Co., Inc., New York, N.Y.

[21] Appl. No.: 157,075

[22] Filed: Jun. 6, 1980

[51] Int. Cl.[3] ..... A47D 51/14

[52] U.S. Cl. ..... 223/96; 24/255 R

[58] Field of Search ..... 223/96, 93, 91; 24/255 R, 255 SL, 260, 336

[56] References Cited

U.S. PATENT DOCUMENTS 3,191,823 6/1965 Edwardes ..... 223/96
3,767,092 10/1973 Garrison et al. ..... 24/336
3,973,705 8/1976 Erthein ..... 223/96
4,023,721 5/1977 Erthein ..... 24/255 R

*Primary Examiner*—Alexander Grosz
*Attorney, Agent, or Firm*—Alexander Mencher

[57] ABSTRACT

A garment clamping hanger having a pair of hinged and plastic clamping members and a relatively high-compression springable clip pivoted to one of said members for holding and releasing said garment or the like therebetween. The clamping members are structured to both resist fracture and to ease finger-controlled operation of the clip, while said clip is shaped, structured and mounted for rotary or swingable operation intermediate the periphery of the clamping members.

11 Claims, 15 Drawing Figures

Fig. 5B.
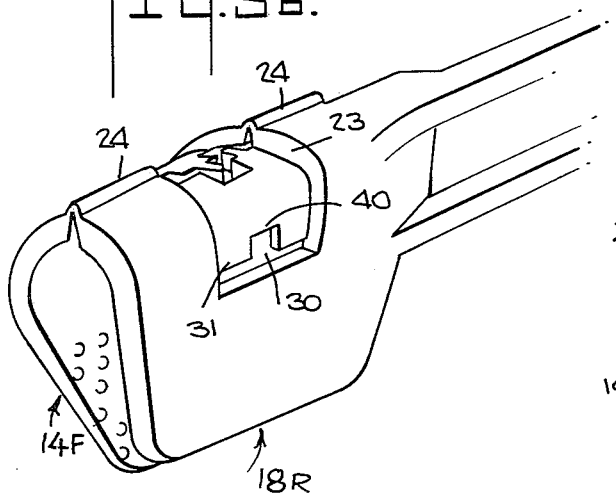
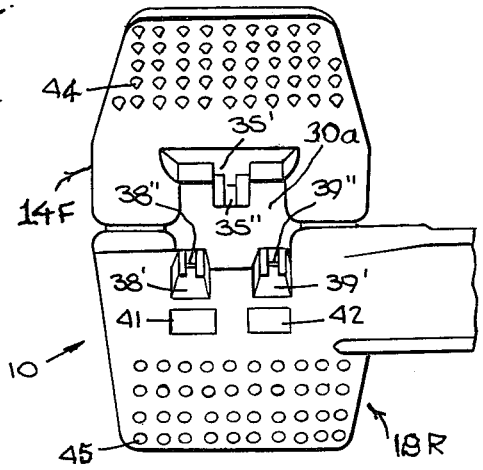
Fig. 6.
Fig. 7.
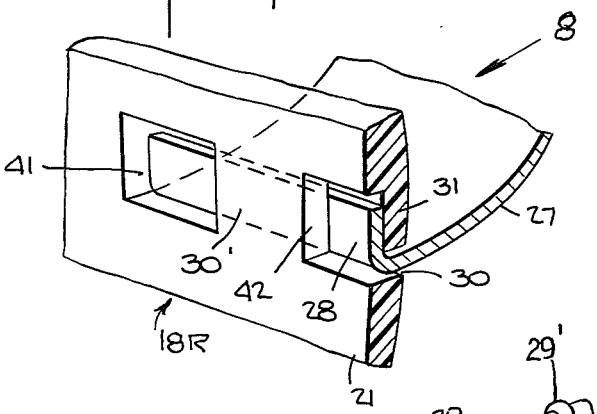
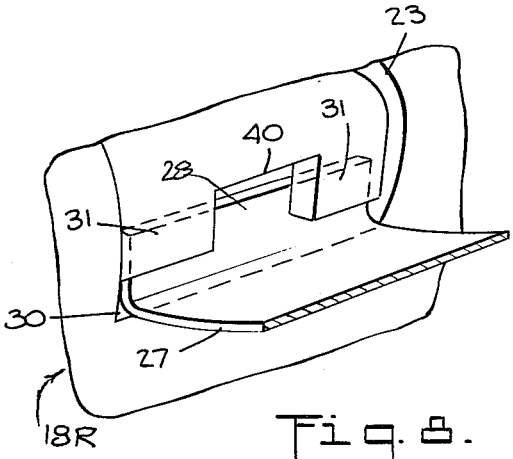
Fig. 8.
Fig. 9.
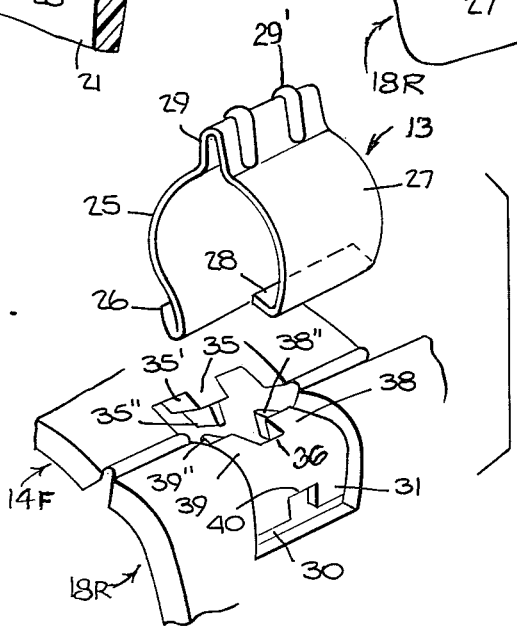

HEAVY AND LIGHT DUTY GARMENT CLAMPING HANGER

BACKGROUND OF THE INVENTION

This invention relates generally to clamping hangers for both heavy and light garments, but more particularly to a springable clip of relatively high-compression capacity for compressing or locking plastic and hinged clamping members for hold and releasing said garment types therebetween. The clip is adapted to be pivotally anchored under tension to one of the clamping members when in open position and springably engagable with the other clamping member when said clip is rotated to closed position for locking said clamping members when either engaging a garment therebetween or otherwise as when not in functional use, as when the device is stored, displayed or shipped.

Clamping types of hangers are known to the art and various spring means are further known for locking the clamping members in closed position to retain garments or the like therebetween. Such types when applied to heavier garments have failed because of lack of spring strength; or when high-compression springs were utilized the clamping members were adversely affected or the springs lacked ease of finger manipulation and operation; or jamming of the spring and ensnarement with surrounding objects have been experienced.

In the patent to Garrison et al., U.S. Pat. No. 3,767,092 dated Oct. 23, 1973, a slidable locking clip of low spring compressive force is utilized and adapted to run in vertical tracks of hinged plastic clamping members and which is intended to be prevented from separation by a cross-bar with the clip slidable therebeneath. In open position, the clip of Garrison loosely projects above the top of the clamp, rattles and may be easily separated by being forced through the cross-bar on being snared in use or by contact. Moreover, the movable clamping member of Garrison tends to jam or separate the clip from the cross-bar when moved to fully open position; and further, little pressure is required to free the clamping members to open position while under spring compression to dislocate and affect future operation.

In a prior invention by applicant herein under U.S. Pat. No. 3,973,705 dated Aug. 10, 1976 over which the present invention is an improvement, a locking spring clip is adapted to pivotally swing over and engage hinged clamping members in closed and for locking position from a position lateral and external to said clamping members. But, as in Garrison (supra), when applicant's spring under said U.S. Pat. No. 3,973,705 is in open position and subject to use, abuse and contact, the clip mounting arm becomes subject to twist about the pin-type pivotal support resulting in possible separation or in inefficient and friction-bound operation.

In Edwards, U.S. Pat. No. 3,191,832 dated June 29, 1965, an angled plastic spring is hinged to a rear clamping member and when in open position the angular portion projects vertically thereabove. Moreover, the spring and clamping members are formed of the same plastic material and obviously is not fitted for heavy duty and long life.

Contrastingly, the spring clip herein is mounted for rotation on and along the width of one of the hinged clamping members and in an orbit intermediate the height of the clamp. The pivotal mounting of the said spring clip when in open position is in the form of a sturdy anchorage under bias of the clip for resistance to twist, misalignment, vibration or loosening through even abusive use, contact and ensnaring elements.

Other patents of the prior art show hinged and clamping members molded of plastic as Loscalzo et al., U.S. Pat. No. 3,487,984 dated Jan. 6, 1970, Boyce, U.S. Pat. No. 3,526,935 dated Sept. 8, 1970 and Batts, U.S. Pat. No. 3,698,607 dated Oct. 17, 1972; but each fails to show any external spring-biasing. Moreover, patents on spring-biased metallic clamps are numerous and need not be enumerated. An example is British Laurie, No. 374,312 dated June 9, 1932 related to a paper clip.

Accordingly, a main object of the invention is to provide a sturdier and longer lasting garment clamp for both heavy and light duty operation and of the type having a body or arm integrally molded with one or more clamps, the clamp being adapted to have pivotally mounted on one of the clamping members a rounded type of spring clip of substantial compressive force, and being rotatable between biased unlocked and biased locked position with respect to the clamping members' open and closed positions respectively.

A further object of the invention is to provide a combination of clamp and spring wherein the spring elements during rotation both forwardly and rearwardly for respective locking and unlocking positions of the clamping members are substantially flush with the top of the clamp thereby averting vertical ensnarable projections.

Another object of the invention resides in the efficient and economical manner of assembling the spring clip to the hanger for non-separability, in the economy in cost of production for throw-away purposes of the hanger, in the positive and easy manner for attaining locking and unlocking position given the highly compressive force of the spring, and in the construction used to prevent accidental opening in the course of usage.

Another object of the invention is to provide improved clamping means for a garment hanger by providing a pair of improved and novel gripping or clamping members hingedly coupled at one end and including a rounded type of spring clip of relatively substantial compressive force, the clamping members being of sufficiently sturdy structure as to be resistant to fracture and damage from said force, and the said spring being pivotally mounted under bias to one of said clamping members for locking and unlocking purposes.

A further object of the invention resides in novel structure and mode of operation of both clamp and locking clip resulting in substantial reduction of friction-producing bearing areas of moving parts. Such reduction permits use of a high compression spring clip normally not applicable to clamps of the type involving plastic and hinged clamping members. Such reduction further facilitates finger manipulation of such a spring clip and increases life and efficiency of clamp and clip parts.

A further object of the invention resides in the novel structure of a high compression locking clip pivotally anchored to one of a pair of novelly structured and hinged clamping members for limited clip rotary movement, the device being light in weight, parts resistant to breakage and fracture, and parts being easy to assemble.

These objects and other incidental ends and advantages will hereinafter appear in the progress of the disclosure and as will be pointed out in the appended claims.

BRIEF DESCRIPTION OF DRAWINGS

FIG. 5B is a partial perspective view as in FIG. 5A but with the locking spring clip omitted.

FIG. 6 is a bottom plan view of the left-hand clamp of FIG. 1 in open or extended position with the locking spring clip omitted.

FIG. 7 is a partial perspective view of FIG. 6 showing how the locking spring clip is pivotally secured to one of the clamping members.

FIG. 8 is a partial perspective view of FIG. 7 in the direction of arrow 8.

FIG. 9 is an exploded view in perspective showing the locking spring clip above and about to be introduced between the clamping members when in open and outstretched position, and resulting in the showing of FIGS. 7 and 8.

PREFERRED EMBODIMENT OF INVENTION

Figures 1, 2, 3A, 3B:
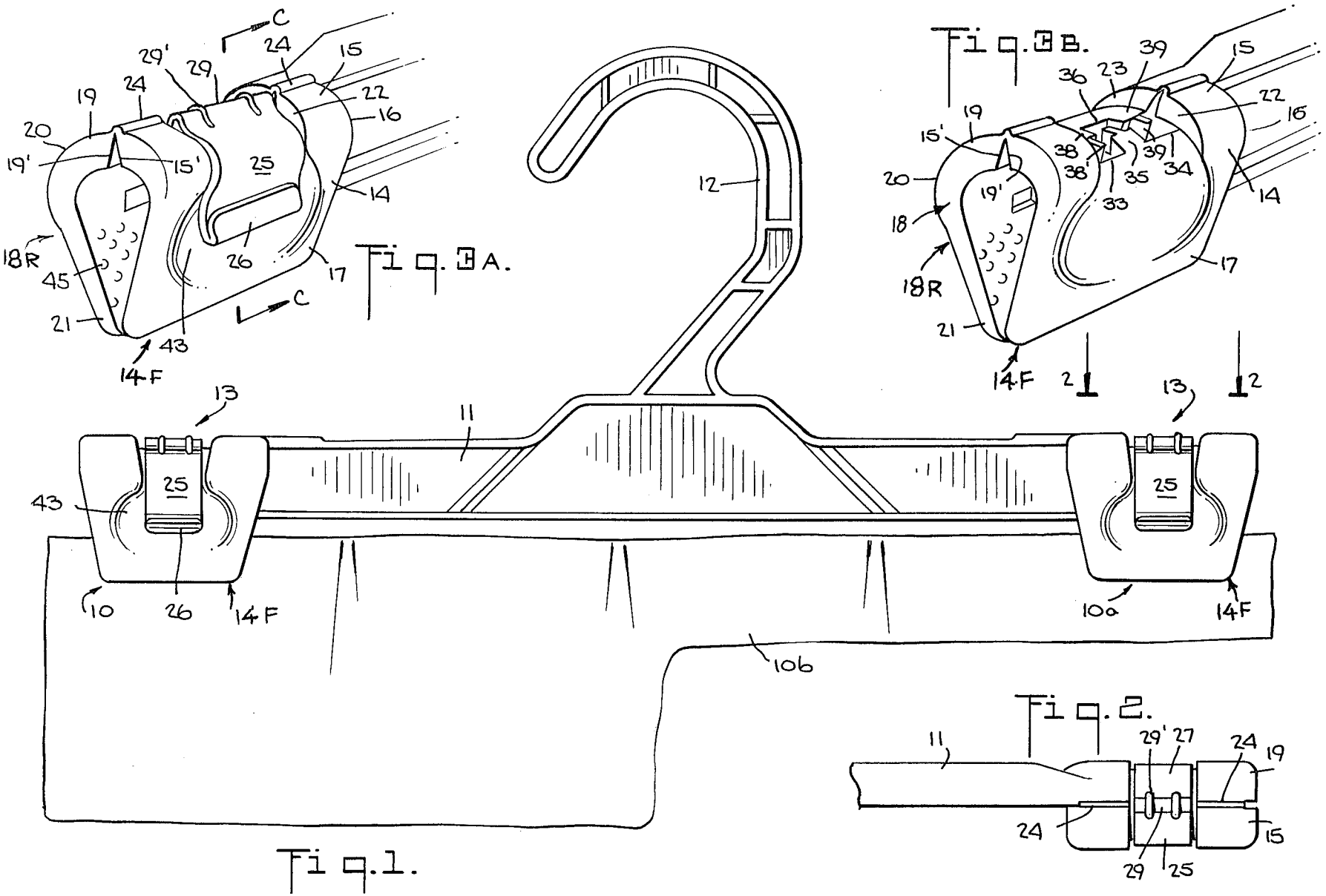
FIG. 1 is a plan view of hanger arm having similar clamps at the ends and shown in locked position by the locking clips.
FIG. 2 is a partial top view of the device shown in FIG. 1 in the direction of plane 2—2.
FIG. 3A is a partial perspective view of the left-hand clamp of FIG. 1 in locked position.
FIG. 3B is a partial perspective view as in FIG. 3A with the clamping members closed but with the locking spring clip omitted.

In accordance with the invention and the preferred form shown, a clamp 10 and a springable compression or locking clip 13 are provided for performing light and heavy duty in suspending of garments as from a hanger or otherwise. As shown in FIG. 1, a duplicate clamp **10*a* is provided joined to clamp 10 as by a crosspiece 11, the latter carrying a hook 12. It is understood that reference numerals applicable to left-hand clamp 10 and clip 13 are also applicable to the right-hand clamp 10*a* carrying the clip. The clamps as shown support a garment 10*b***.

The clamp and clip pivotally secured thereto under tension are harmonized in novel and improved structural features and functions to provide a relatively high-compression type of spring and hinged front and rear clamping or gripping members 14F and 18R conformed to sustain the spring load. The gripping members are suitably mold-formed by any known procedures from available resin materials including polypropylene, polyethylene, and the spring 13 is preferably formed from steel. From the standpoint of operation, as will appear hereinafter, no greater finger pressure is applied for clip operation than for the conventional low-pressure type of spring heretofore used in the art. Areas of rotary clip movement are confined substantially within the perimeter of the clamp. When the clamping members are in open position, the clip is disposed behind the outer face of rear clamping member 18R and supported at one end and under tension to the top wall 19 thereof. When the clamping members are in closed position and under compression of clip 13, the clip lies substantially flush with the outer faces of clamping member 14F and 18R and over the respective top walls thereof as will appear and best illustrated in FIGS. 3A, 3C, 4A and 4C. Such areas of operation and positions of clip 13 present both obvious indicators of clip operation to the user and clearance against clip ensnarement with surrounding objects.

CLAMP AND SPRING CLIP ELEMENTS

Figure 4A:
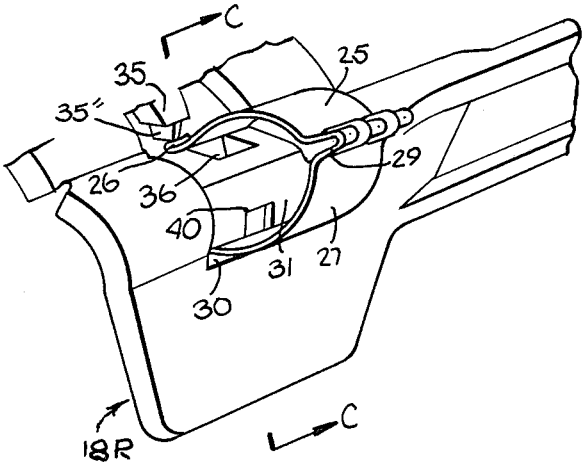
FIG. 4A is a partial perspective view of the locking spring clip of the right-hand clamp of FIG. 1 when in fully opened and final position.
Figure 4B:
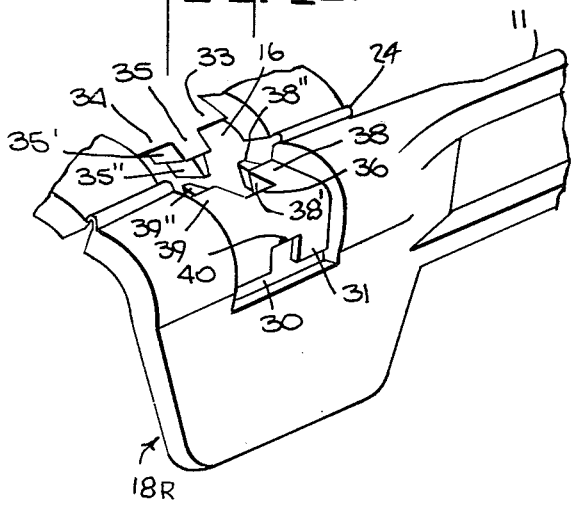
FIG. 4B is a partial perspective view similar to FIG. 4A but with the locking spring clip omitted.
Figure 4C:
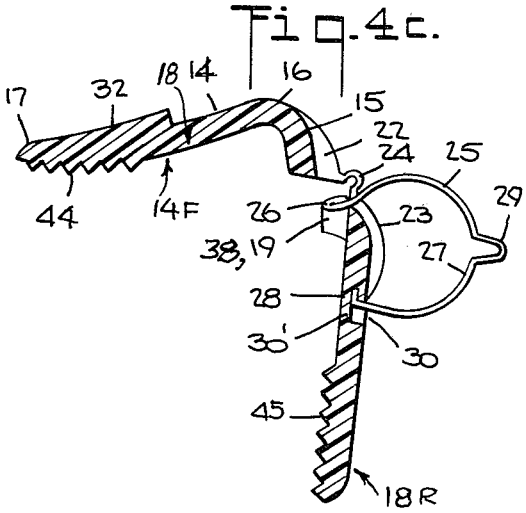
FIG. 4C is a cross-sectional view of FIG. 4A along the plane C—C thereof.

By reference to FIGS. 3B and 4C, front clamping member 14F is comprised of an upper portion 14 having an inwardly directed flange or top wall 15 extending from a rounded shoulder 16, and a lower portion 17. Similarly, rear clamping member 18R has an upper portion 18 having an inwardly directed flange or top wall 19 extending from a rounded shoulder 20, and a lower portion 21. Said front and rear clamping or gripping members intermediate the width thereof are adapted to accommodate springable clip 13 for compressing or locking the closed position of the gripping members and for anchoring under tension clip 13 to the rear gripping member when said members are in open or article releasing position.

Thus, springable clip 13 desirably and to avoid projection of front and top parts is operational within depressed or recesses areas in the outer faces of front and rear gripping members 14F and 18R, and as best seen in FIGS. 5B, 6, 7, 8 and 9. Such areas with respect to the front gripping member 14F are indicated by numeral 22 and extend continuously from top wall 15 to the upper edge of lower portion 17, and with respect to the rear gripping member 18F, such areas are indicated by numeral 23 and extend continuously from top wall 19 to the upper edge of lower portion 21. Gripping members 14F and 18R are hingedly secured on the opposing top wall 15 and 19 and on each side of recesses 22 and 23 by suitable means as by webbing 24.

Springable clip 13 and the contours of recesses 22 and 23 are adapted to conform. Thus, clip 13 has a front convexly curved leg such as a circular segment and terminating at the lower and inwardly directed edge in an outwardly and upwardly curved cam-follower-type tab 26. (FIG. 9) and a rear and similarly convexly curved leg 27 terminating at the lower edge in an inwardly directed offset 28 at a suitable and operational angle such as between 80 and 90 degrees for limiting hinge functioning in conjunction with rear gripping member 18R as will later be described.

Figure 3C:
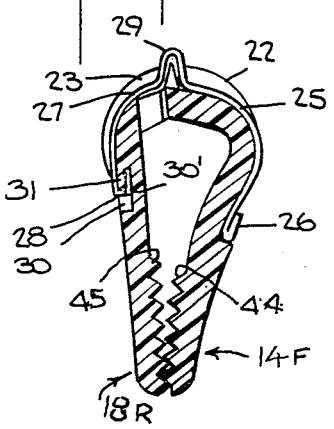
FIG. 3C is a cross-sectional view of FIG. 3A along the plane C—C thereof.

Clip 13 by virtue of a top inverted U-shaped portion 29 from which front and rear clip legs 25 and 27 outwardly extend attains the high compressive power heretofore mentioned for purposes of compressing or locking the gripping members 14F and 18R when in closed and article gripping position (FIGS. 3A and 3C). As shown, U-shaped clip portion 29 if desired may have reinforcing sections 29' for adding compressive force and/or prolonging the life of the clip. Moreover, clip portion 29 further serves as finger engaging means to rotate the clip forwardly from open and non-compressing position to closed and compressing condition with respect to the clamping or gripping members 14F and 18R as will appear in the mode of operation of the device.

SPRING CLIP ANCHORAGE AND SPECIFIC CLAMP STRUCTURE

Springable locking clip 13 is adapted to be hingedly and releasably anchored for limited rotary movement to the outer face of rear clamping or gripping member 18R at rear clip leg 27 and to be tensioned against the top wall 19 at front clip leg 25 against possible dislocation by outside forces when said clip is in non-compressive position and while the gripping members 14F and 18R are in open or article releasing position as best illustrated in FIGS. 4A and 4C. And in operation, the clip is adapted at tab 26 to ride along the gripping member top walls 15 and 19 and shoulder 16 toward attaining final compressive position as when the gripping members are in closed or article gripping position as best illustrated in FIGS. 1, 3A and 3C.

Although it is understood that conventional and hinged anchorage and traversing of engagable top wall surfaces of the gripping members may be within the limits of the invention as old elements with respect to clip operation on garment clamps, the novel use of a relatively high-compression spring clip 13 as herein described plus a consequent novel modification of gripping members 14F and 18R are further included within the invention herein. Said modification involves ease of finger operation of the clip as by reducing the sliding friction areas; provision of an opening **30*a* between the gripping members for ease of assemblage with the clip; provision of suitable notching and projections to provide for mortise and tenon relationship; and provision for gap spanning during clip operation between top walls 15 and 19. Moreover, suitable reinforcements involving elements in said top walls 15 and 19** to sustain high-compression clip pressure are also provided.

Thus, rear gripping member 18R at the bottom of recess 23 as best illustrated in FIGS. 7, 8 and 9 is provided with a transverse groove or mouth 30 for introduction of offset 28 of rear spring clip leg 27. Said groove 30 serves as an inlet to an upwardly extending undercut having a floor 30' and an overhang 31 for hinged engagement and disassemblable anchorage with the clip area at offset 28. In order to permit such introduction with the use of the high-compression clip as herein structurally described, the front clip leg 25 is placed in a position penetrating opening **30*a* as inferred from FIGS. 6 and 9 between the gripping member top walls 15 and 19 when said members are in open or outstretched article releasing position, and leg 27 is then led through mouth 30 at the offset area 28 and then up the undercut between floor 30' and overhang 31. When the clip is in said position, clip forward leg 25 is withdrawn from opening 30*a* and forced on to top wall 19 of rear gripping member 18R for tensioned engagement therewith as best illustrated in FIG. 4C. In such position, the clip is prevented from further rear rotary movement by the positioning of offset 28 between floor 30' and overhang 31 and is in normal non-compressive condition for the open position of the clamping member 14F and 18R. Forward rotary movement as initiated by finger engagable U-shaped clip portion 29 toward compressed condition of the clamping members when in closed or article gripping position causes movement of the clip offset area to the position best shown in FIG. 3C for indicating hinge-anchorage function. For removal of clip 13, gripping members 14F and 18R are spread apart and leg 25 forced through opening 30*a* for spring clip relaxation, and thereupon rear clip leg 27 may be manipulated for removal through mouth 30**.

To effect opening **30*a* and to reduce friction areas in connection with the rotary movement of clip tab 26 engagable with gripping member top walls 15 and 19, the transverse edges 15' and 19' of the gripping member top walls are inwardly bevelled. This brings about converging positions of the gripping members 14F and 18R. Furthermore, the top walls themselves are mutually modified, notched, and provided with projections to form mortise and tenon elements when in closed position (FIG. 3B) for bridging a gap (hereinafter described) during movement of clip tab 26 over the top walls 15 and 19 toward compressing or locking position of the clip. Such bridging prevents clip leg 25** from falling through said gap and attaining relaxed position therein when the gripping members have a thick article therebetween to cause a spread between the clamping members.

Thus, in the recessed portion of top wall 15 there are provided similar spaced and inwardly directed notches 33 and 34 leaving an intermediate clip-supporting tongue 35, said tongue having an underside and buttressed reinforcement 35' and projection 35''. In recessed portion of top wall 19 there is provided an inwardly directed intermediate notch 36 forming laterally disposed clip supports or floors 38 and 39, support 38 having an underside reinforcement 38' and also a projection 38'', while support 39 has a similar underside reinforcement 39' and a similar projection 39''. By referring to FIG. 3B, it is seen how the projection 35'' of tongue 35 enters notch 36 while projections 38'' and 39'' of lateral supports 38 and 39 enter respective notches 33 and 34 for closing the gap between the opposing edges of both tongue 35 and lateral supports or floors 38 and 39. As hereinbefore stated, tongue underside reinforcement 35' and lateral support or floor reinforcements 38' and 39' sustain the high compressive spring pressure on said tongue 35 and said supports 38 and 39.

To further reduce friction areas in operation between clip 13 and the gripping members 14F and 18R at the hinged anchorage area, an intermediate notch 40 is provided on overhang 31, while lateral notches 41 and 42 are provided on floor 30' as best seen in FIGS. 7 and 8. FIG. 6 also shows spaced projections 44 and 45 on the inner faces and the lower gripping portions 17 and 21 of gripping members 14F and 18R respectively to add friction to the grip on article **10*b*** therebetween.

MODE OF OPERATION AND FUNCTIONS

In operation of the clamping members 14F and 18R with clip 13 assembled therewith, the article **10*b* to be clamped and spring-locked therebetween is inserted between said clamping members and temporarily held by bringing the said members together between the thumb and middle finger of the hand. Thereupon the index finger of the hand engages and forces with slight pressure the U-shaped portion 29 of clip 13 for forward rotary movement from the position shown in FIG. 4C or initial position or station to the position shown in FIG. 3C** or final position.

Figure 5A:
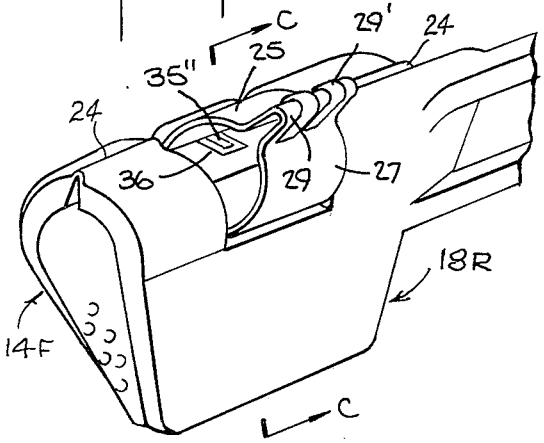
FIG. 5A is a partial perspective view of the right-hand clamp of FIG. 1 wherein the locking spring clip is in mid-locked position.
Figure 5C:
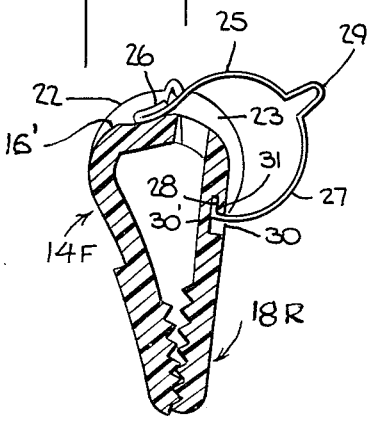
FIG. 5C is a cross-sectional view of FIG. 5A along the plane C—C thereof.

Between open or initial and closed or final positions of clip 13 best illustrated in FIGS. 4C and 3C respectively, tab 26 is slideably forced from top wall 19 at support portions 38 and 39 to the declining top wall 15 of tongue area 35 as best seen in FIG. 5C and which represents wherever and whenever desirable an intermediate station or position for motion braking by virtue of a surmountable restraint projection 16' at the upper end of shoulder 16. Further movement of tab 26 brings same over the rounded shoulder 16 and into a locking position by detent elements formed between the lower inwardly directed portion of shoulder 16 and a thumb engaging depression 43 in the outer face of lower portion 17 of the gripping member 14F. In such locking or final position or station, clip 13 in all its parts is disposed within the recesses 22 and 23 and thumb depression 43 as shown in FIGS. 1 and 3A, while the longer front clip leg is shown to extend below the area of anchorage of the shorter rear clip leg 27 for making operation and function of the clip more efficient. For disengaging clip 13 from such locked position, tab 26 in depression 45 is pushed upwardly as by slight thumb pressure and the clip snaps back to open position as best illustrated in FIG. 4.

LIMITS OF THE INVENTION

Reduced areas of friction as by the notching described, as well as for the walls and areas over which clip tab 26 rides to sustain pressure of the high-compression clip may be eliminated under the invention by utilization of improved qualities in plastic material or by increasing dimensioning of parts. Moreover, the projections 35'', 38'' and 39'' may be substituted by extensions of top walls 15 and 19 of clamping members 14F and 18R.

Ease of clip operation under the invention furthermore is afforded by the levered rotary operation thereof in conjunction with the traversed contours of the clamping members as best shown in the drawings.

It is understood further that minor variations in the structure, shape, size, location, material and integration of parts may all be resorted to without departing from the spirit of the invention and the scope of the appended claims.

I claim:

1. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip.

2. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front and thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, and a supporting arm for the hanger clamp connected to said rear gripping member.

3. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, a second clamp similar to said first-mentioned clamp and spaced therefrom, and an arm connecting said clamps.

4. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, the inner faces of said gripping members having article retaining means.

5. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, said locking clip being comprised of opposing front and rear legs each being convexly curved and having a U-shaped top junction portion from which said legs are offset and extend, the said legs being adapted to engage portions of the said gripping members when the clip is in said final position.

6. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, said locking clip being comprised of opposing front and rear legs each being convexly curved and having a U-shaped top junction portion from which said legs are offset and extend, the said legs being adapted to engage portions of the said gripping members when the clip is in said final position, each of said gripping members on the outer faces having recesses in the top wall intermediate the width thereof and extending downwardly and terminating above the bottom, said clip in said final position being positioned within said recesses to avoid projections with respect to the outer faces of the gripping members.

7. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, said locking clip being comprised of opposing front and rear legs each being convexly curved and having a U-shaped top junction portion from which said legs are offset and extend, the said legs being adapted to engage portions of the said gripping members when the clip is in said final position, each of said gripping members on the outer faces having recesses in the top wall intermediate the width thereof and extending downwardly and terminating above the bottom, said clip in said final position being positioned within said recesses to avoid projections with respect to the outer faces of the gripping members, said rear and front gripping members within the respective said recesses thereof and below the top walls thereof each being convexly curved downwardly and inwardly for the conformation and engagement with the rear and front clip legs.

8. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, said locking clip being comprised of opposing front and rear legs each being convexly curved and having a U-shaped top junction portion from which said legs are offset and extend, the said legs being adapted to engage portions of the said gripping members when the clip is in said final position, each of said gripping members on the outer faces having recesses in the top wall intermediate the width thereof and extending downwardly and terminating above the bottom, said clip in said final position being positioned within said recesses to avoid projections with respect to the outer faces of the gripping members, said rear and front gripping members within the respective said recesses thereof and below the top walls thereof each being convexly curved downwardly and inwardly for the conformation and engagement with the rear and front clip legs, the clip front leg terminating at the end thereof in a camfollower-type tab for slideable engagement with the recessed portions of the gripping members and wherein the lower end of the recess in the front gripping member is provided with a thumb-engaging depression thereby forming detent elements for releasable locking of the clip in final position.

9. A garment hanger clamp comprising rear and front gripping members hinged at the top walls to form relatively stationary and movable parts respectively for movement between a closed and locked article gripping position and an open and unlocked article releasing position, a springable locking clip operable on the outer faces of said gripping members and intermediate the width thereof and adapted to have at least an initial position when the gripping members are open and a final position when the gripping members are closed and in article gripping position, pivotal anchoring means for the clip and between the rear end of said clip and the rear gripping member intermediate the height thereof and including stop means for rearwardly limited rotary movement of said clip, and whereby said clip in said initial position has the front end thereof releasably tensioned against the top wall of said rear gripping member, said clip in said initial position projecting behind and substantially below the top of the rear gripping member, said clip in said final position overlying the top walls and engaging at least portions of the outer faces of the gripping members, said clip attaining said final from initial position by forward rotary movement thereof and attaining initial from final position by rearward movement thereof, said top walls of the gripping members having openable bridge means for creating an opening therebetween for introduction and withdrawal of the said front end of the clip to effectuate said pivotal anchoring of the clip, said locking clip being comprised of opposing front and rear legs each being convexly curved and having a U-shaped top junction portion from which said legs are offset and extend, the said legs being adapted to engage portions of the said gripping members when the clip is in said final position, each of said gripping members on the outer faces having recesses in the top wall intermediate the width thereof and extending downwardly and terminating above the bottom, said clip in said final position being positioned within said recesses to avoid projections with respect to the outer faces of the gripping members, said rear and front gripping members within the respective said recesses thereof and below the top walls thereof each being convexly curved downwardly and inwardly for the conformation and engagement with the rear and front clip legs, the clip front leg terminating at the end thereof in a cam-follower-type tab for slideable engagement with the recessed portions of the gripping members and wherein the lower end of the recess on the front gripping member is provided with a thumb-engaging depression thereby forming detent elements for releasable locking of the clip in final position, said rear gripping member at the lower end of the recess therein having a bearing socket and an overhang and said rear clip leg having an end offset for disengageable pivotal anchorage therebetween and for limitation of clip rearward pivotal movement when said clip is in said final position.

10. A garment hanger clamp having opposing front and rear plastic gripping members having inwardly directed and hinged top walls for member movement between a closed and releasably locked article holding or gripping position and an open article releasing position, the improvement comprising:

a springable locking clip having opposing and convexly curved front and rear legs and a top inverted U-shaped finger engagable portion from which said legs are offset and extend;

pivotal and disengagable anchorage means between the end of said rear clip leg and the outer face of the rear gripping member for limited rearward rotary clip movement;

said gripping members on the outer faces and below said top walls having convexly curved surfaces conforming with the shape of said convexly curved legs;

a cam-follower-type and finger engagable tab at the end of said front clip leg and normally engaging under clip spring tension the rear gripping member top wall, said tab being adapted to engage and ride along the front gripping member top and convexly curved surface from open position toward closed position by forward finger pressure applied to said U-shaped clip portion, and said clip being adapted to be snapped back from closed position to open position by thumb pressure on said tab, said top walls and convexly curved outer faces of said gripping members intermediate the width thereof being recessed to receive the said springable clip legs and said top inverted U-shaped finger engagable portion for flush relationship with the surfaces of the gripping members when said clip is in releasably locked position over the closed and article holding gripping members.

11. A garment hanger clamp having opposing front and rear plastic gripping members having inwardly directed and hinged top walls for member movement between a closed and releasably locked article holding or gripping position and an open article releasing position, the improvement comprising:

a springable locking clip having opposing and convexly curved front and rear legs and a top inverted U-shaped finger engagable portion from which said legs are offset and extend;

pivotal and disengagable anchorage means between the end of said rear clip leg and the outer face of the rear gripping member for limited rearward rotary clip movement;

said gripping members on the outer faces and below said top walls having convexly curved surfaces conforming with the shape of said convexly curved legs;

a cam-follower-type and finger engagable tab at the end of said front clip leg and normally engaging under clip spring tension the rear gripping member top wall, said tab being adapted to engage and ride along the front gripping member top and convexly curved surface from open position toward closed position by forward finger pressure applied to said U-shaped clip portion, and said clip being adapted to be snapped back from closed position to open position by thumb pressure on said tab, the said top walls having openable bridge means for creating an opening therebetween for introduction therein of the clip front leg while the gripping members are in spread position and during pivotal anchorage of the clip rear leg on said rear gripping member and for withdrawal of said front leg thereafter for placement under tension on the top wall of the said gripping member to effectuate open position of the springable clip.

* * * * *